US006267615B1

(12) United States Patent
Lin

(10) Patent No.: US 6,267,615 B1
(45) Date of Patent: Jul. 31, 2001

(54) CONTACT FOR SOCKET CONNECTOR

(75) Inventor: Nick Lin, Hsin-Chuang (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/792,802

(22) Filed: Feb. 23, 2001

(30) Foreign Application Priority Data

Dec. 29, 2000 (TW) ..... 89222762

(51) Int. Cl.[7] ..... H01R 4/50
(52) U.S. Cl. ..... 439/342; 439/857
(58) Field of Search ..... 439/342, 259, 439/857, 268, 266, 265

(56) References Cited

U.S. PATENT DOCUMENTS 4,832,611 * 5/1989 Noda et al. ..... 439/342
5,299,950 * 4/1994 Kaneko ..... 439/342
5,443,591 * 8/1995 Tsai ..... 439/342
5,454,727 * 10/1995 Hsu ..... 439/342
5,797,774 * 8/1998 Kaneko ..... 439/342

* cited by examiner

*Primary Examiner*—Tho D. Ta
(74) *Attorney, Agent, or Firm*—Wei Te Chung

(57) ABSTRACT

A contact (1) for a socket connector includes a base (10) and a pair of arm sections (20). The base has a body section (12), a head section (11) for being secured in the socket connector, and a soldering section (14) for being soldered onto a printed circuit board. Each arm section includes an upper arm (21) extending obliquely downwardly from a lateral side of the body section, a forearm (25) extending upwardly from a free end of the upper arm, a clamp (27) at an upper end of the forearm, and a palm 28 (or 29) extending obliquely from the clamp toward the body section. A free space (301) is defined between the palms. A clamping space (271) is defined between the clamps. A pin of a CPU is adapted to engage between the clamps and establish electrical connection therebetween.

10 Claims, 5 Drawing Sheets

CONTACT FOR SOCKET CONNECTOR

FIELD OF THE INVENTION

The present invention relates to a contact for an electrical connector, and particularly to a contact for a Central Processing Unit (CPU) socket connector.

BACKGROUND OF THE INVENTION

U.S. Pat. No. 4,498,725 discloses a conventional contact for a CPU socket connector, as is shown in FIG. 4. The contact comprises a base 90, a soldering tail 92 depending from the base 90, and a pair of arms 94 extending upwardly and rearwardly from the base 90. Forwardly extending palms 98 are connected to the arms 94 by twists 96.

One of a plurality of pins (not shown) of a CPU is resiliently clamped between the palms 98, for establishing an electrical connection therebetween. As the palms 98 are cantilevers having limited effective length, their resilience is relatively small. When the contact and the pin are subjected to vibration or shock, transmission of electrical signals may be adversely affected.

Furthermore, the two arms 94 are arranged symmetrically. When the pin is moved from a wide space 961 between the twists 96 to a narrow space 981 between the palms 98, it contacts the arms 94 simultaneously. At this point, resistance to further movement of the pin is excessively large. This makes interposition of the pin between the arms 94 unduly difficult. Thus bent or broken pins or poor electrical connection can result.

Hence, an improved electrical connector is required to overcome the disadvantages of the related art.

SUMMARY OF THE INVENTION

A main object of the present invention is to provide a contact for a socket connector providing improved mating force against a pin of a CPU.

Another object of the present invention is to provide a socket contact which substantially reduces force required to move a pin of a CPU from a free space of the contact into a clamping space of the contact.

To achieve the above-mentioned objects, a contact for a socket connector in accordance with the present invention includes a base and a pair of arm sections. The base has a body section, a head section for being secured in the socket connector, and a soldering section for being soldered onto a printed circuit board.

Each arm section includes an upper arm extending obliquely downwardly from a lateral side of the body section, a forearm extending upwardly from a free end of the upper arm, a clamp at an upper end of the forearm, and a palm extending obliquely from the clamp toward the body section. A free space is defined between the palms. A clamping space is defined between the clamps. The pin is adapted to engage between the clamps and establish electrical connection therebetween.

Since the pin is engaged between the clamps rather than at free ends of the palms, mating force exerted by the clamps against the pin is enhanced.

The first clamp is longer than the second clamp. When the pin is moved toward the clamping space, it firstly contacts the palm connected to the end of the first clamp, and thereafter contacts the other palm connected to the end of the second clamp. Thus resistance during engaging of the pin is reduced.

Other objects, advantages and novel features of the present invention will be drawn from the following detailed description of preferred embodiments of the present invention with the attached drawings, in which:

DETAILED DESCRIPTION OF THE INVENTION

Figure 1:
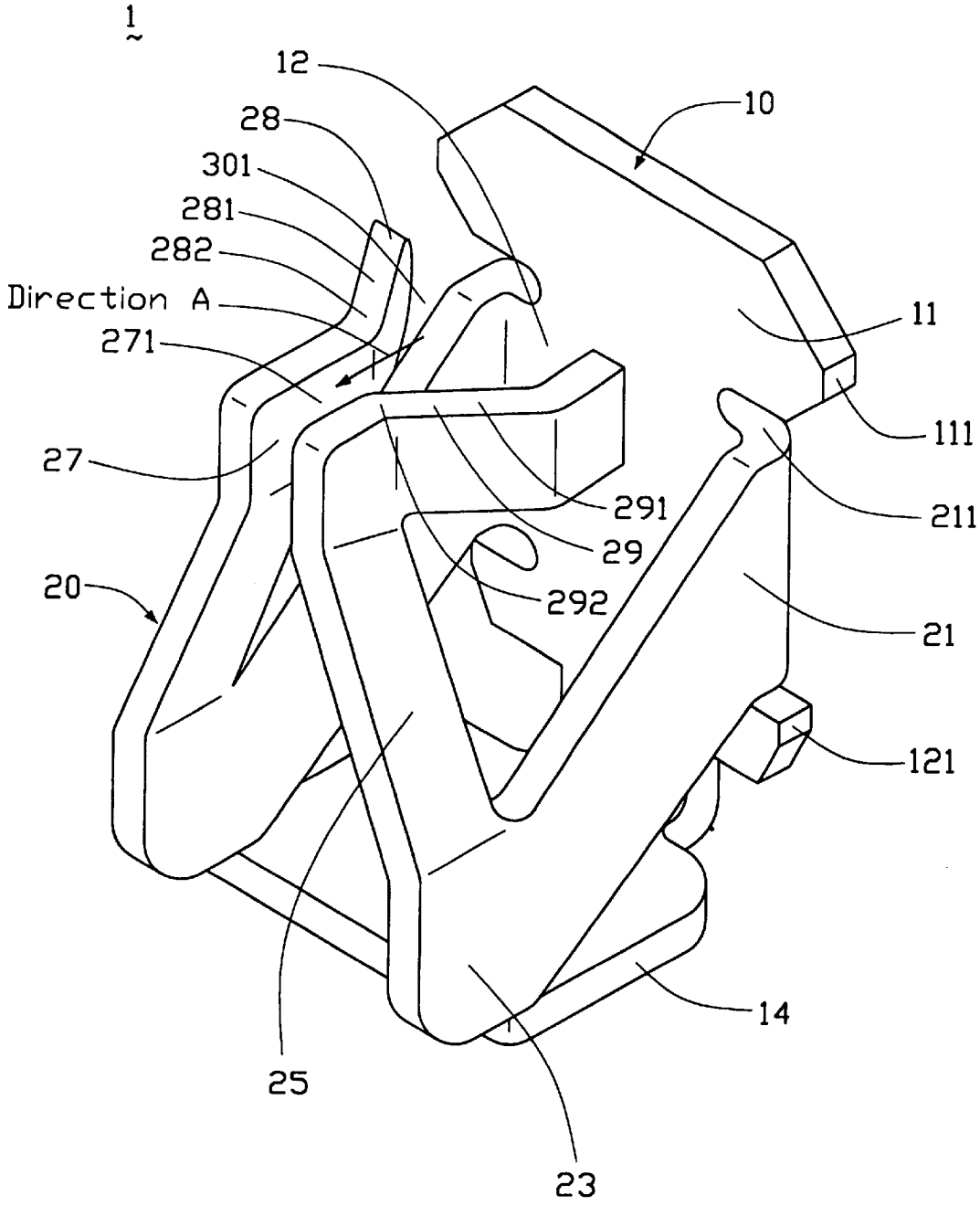
FIG. 1 is a perspective view of a contact for a CPU socket connector in accordance with a first embodiment of the present invention.

Referring to FIG. 1, a metallic contact 1 for a CPU socket connector (not shown) in accordance with a first embodiment of the present invention comprises a base 10 and a pair of arm sections 20 connected to the base 10.

The base 10 includes a body section 12, a head section 11 extending upwardly from the body section 12, and a soldering section 14 extending perpendicularly from a bottom edge of the body section 12. A pair of upper projections 111 is respectively formed at top portions of opposite lateral edges of the head section 11, for interferentially securing the contact 1 in the CPU socket connector. A pair of lower projections 121 is respectively formed at bottom portions of the opposite lateral edges of the body section 12, for interferentially securing the contact 1 in the CPU socket connector. A junction 211 is defined where each arm section 20 meets the body section 12.

Each arm section 20 extends to a height substantially the same as a height of the base 10. Each arm section 20 includes an upper arm 21 extending obliquely downwardly from the junction 211 toward the soldering section 14, an elbow 23 at a bottom portion of the upper arm 21, a forearm 25 extending upwardly from the elbow 23, a substantially planar clamp 27 at a top portion of the forearm 25, and a palm 28 (or 29) extending from a distal end of the clamp 27 toward the body section 12. The forearms 25 of the two arm sections 20 are inclined inwardly toward each other, and the palms 28, 29 of the two arm sections 20 are inclined outwardly away from each other. Guiding portions 281, 291 of the palms 28, 29 are connected to the clamps 27 by bent portions 282, 292 respectively. The two palms 28, 29 and the body section 12 together define a free space 301 therebetween. The two clamps 27 define a clamping space 271 therebetween, for clamping of a pin (not labeled) therein. An engaging direction A is defined perpendicular to the base 10, such that a pin 5 (see FIGS. 2A–2E) of a CPU moves from the free space 301 to the clamping space 271 along direction A during engagement of the pin 5 with the contact 1. A length of oneclamp 27 along direction A is greater than a length of another clamp 27 along direction A. Thus when the pin 5 moves from the free space 301 to the clamping space 271, the guiding portion 281 contacts the pin 5 first, and the guiding portion 291 contacts the pin 5 thereafter.

Figure 2A:
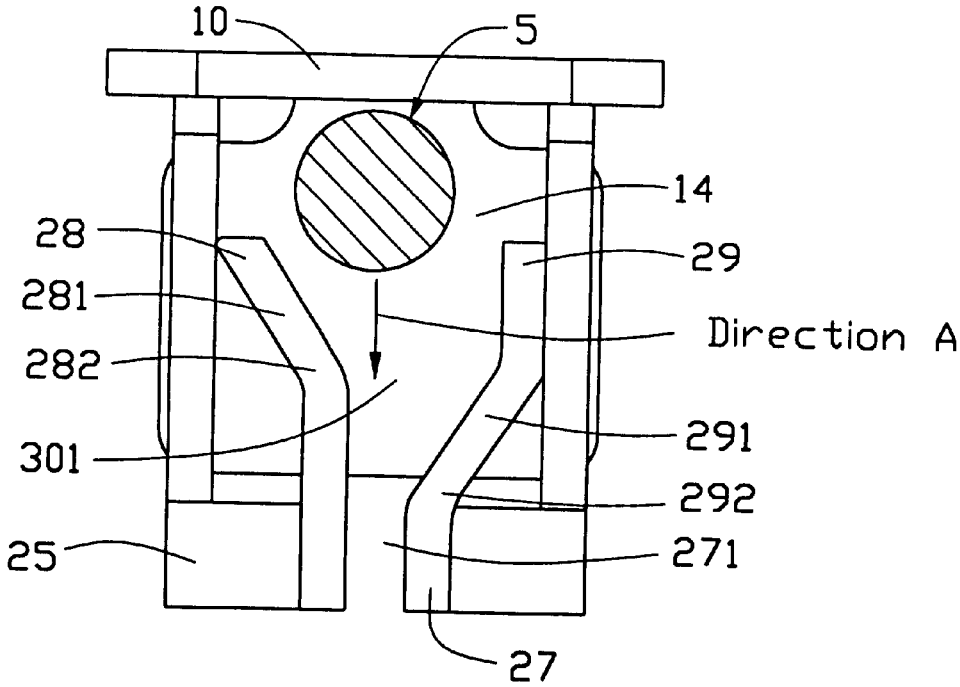
FIGS. 2A, 2B, 2C, 2D and 2E are top plan views of the socket contact of FIG. 1, showing progressive stages of engagement of a pin of a CPU with the socket contact.

Referring to FIG. 2A, the pin 5 is vertically inserted into the free space 301 between the two palms 28, 29. The pin 5 does not contact the guiding portion 281 or the guiding portion 291 of the palms.

Figure 2B:
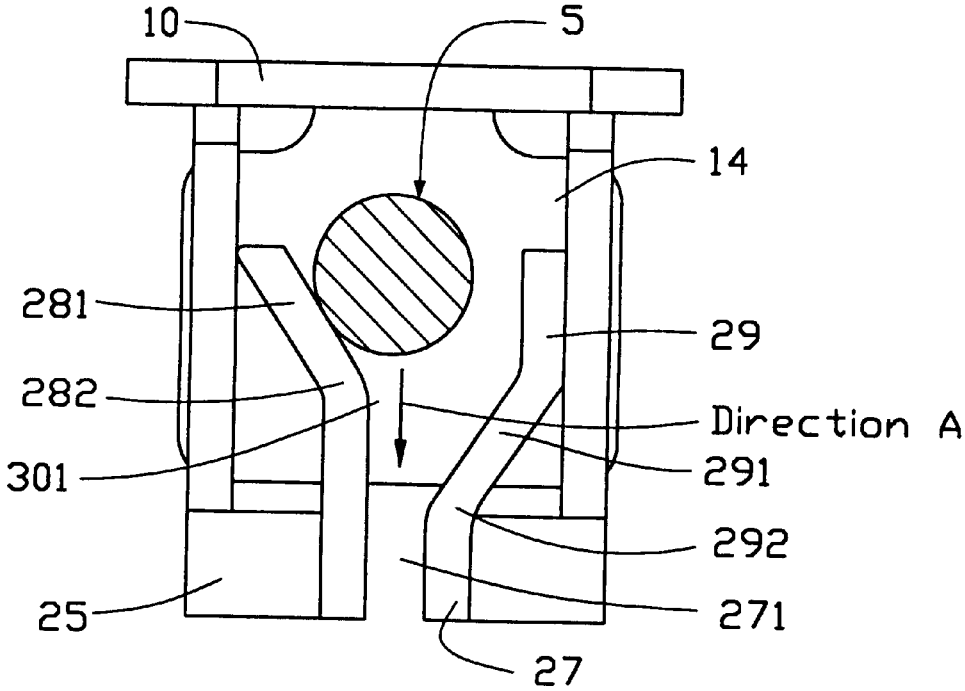

Referring to FIG. 2B, the pin 5 is then moved in direction A from the free space 301 toward the clamping space 271 by conventional operating force. The first guiding portion 281 contacts the pin 5.

Figure 2C:
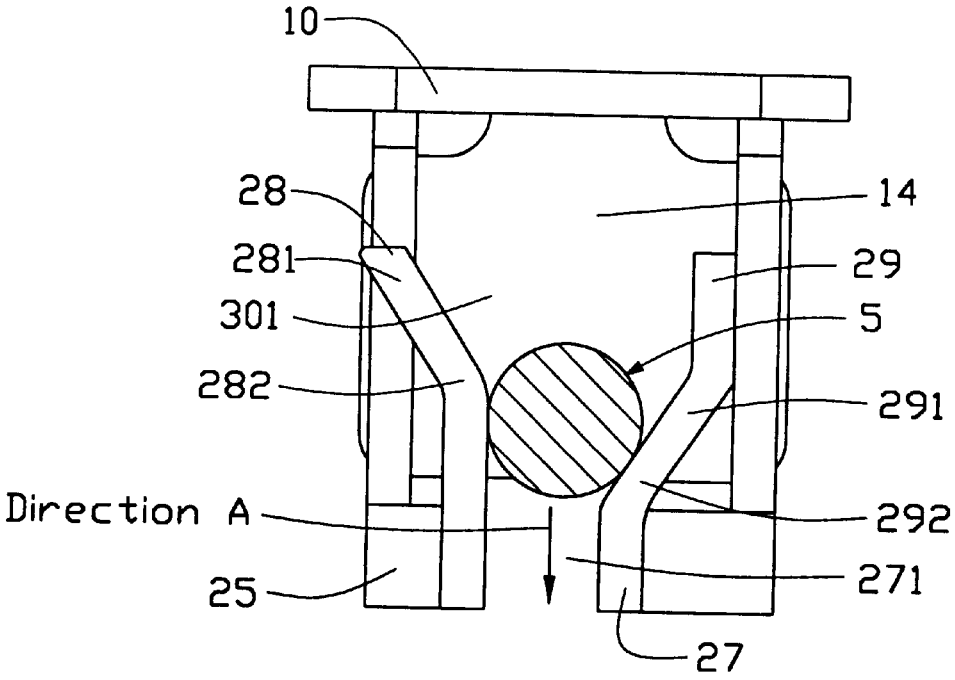

Referring to FIG. 2C, the pin 5 continues to be moved in direction A toward the clamping space 271. The pin 5 passes over the bent portion 282 of the first palm 28, and contacts the guiding portion 291 of the second palm 29. The pin 5 subsequently begins to engage between the clamps 27.

Figure 2D:
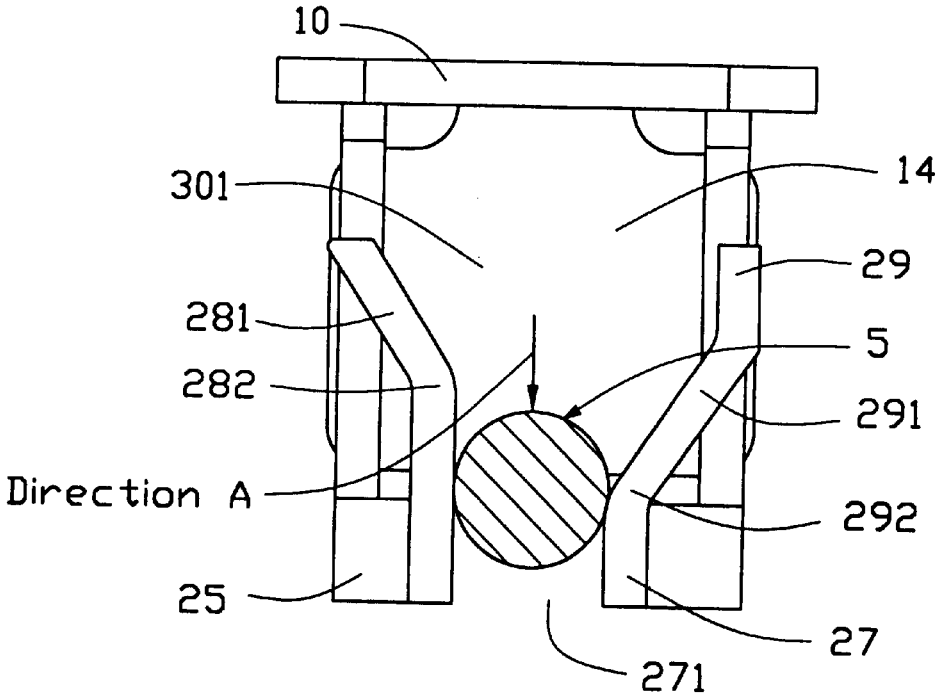
Figure 2E:
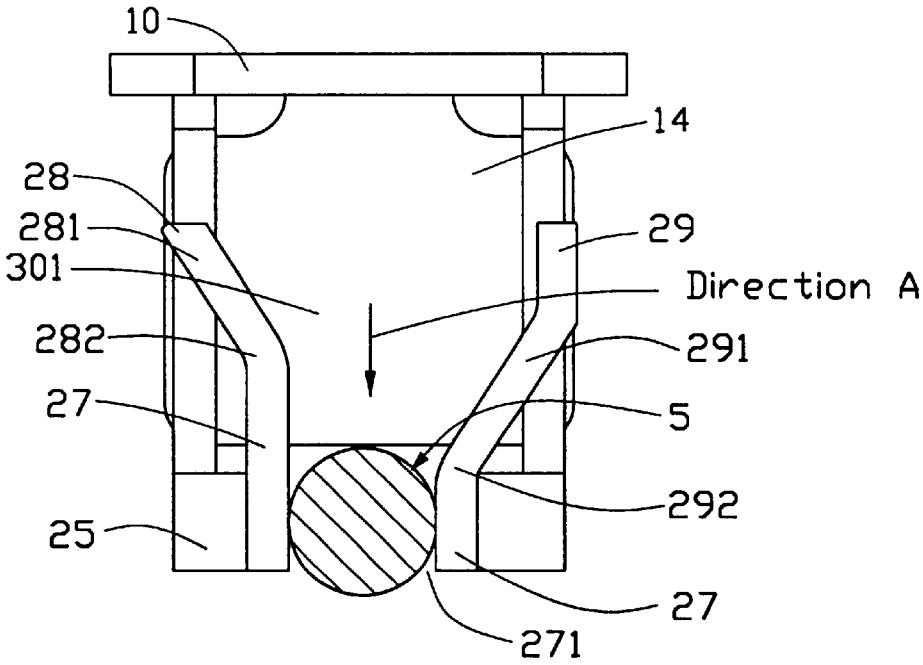

Referring to FIGS. 2D and 2E, the pin 5 is moved farther in direction A into the clamping space 271. The pin 5 passes the bent portion 292 of the second palm 29, and is clamped between the clamps 27. The pin 5 is thus resiliently and firmly connected with the contact 1 of the CPU socket connector.

Figure 3:
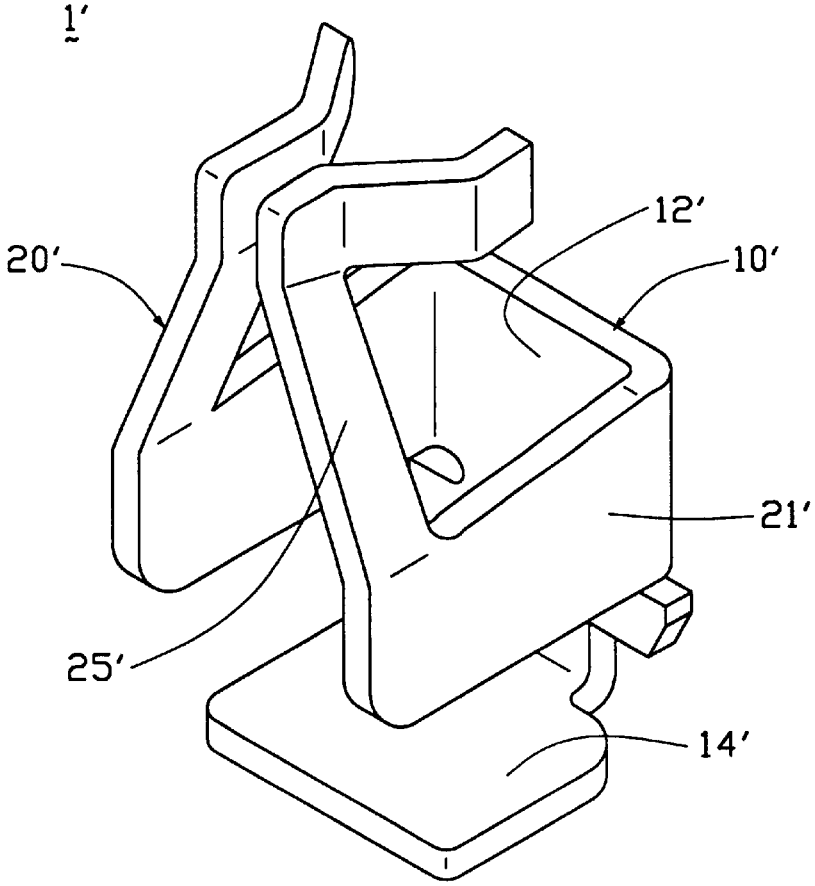
FIG. 3 is a perspective view of a contact for a CPU socket connector in accordance with a second embodiment of the present invention.
Figure 4:
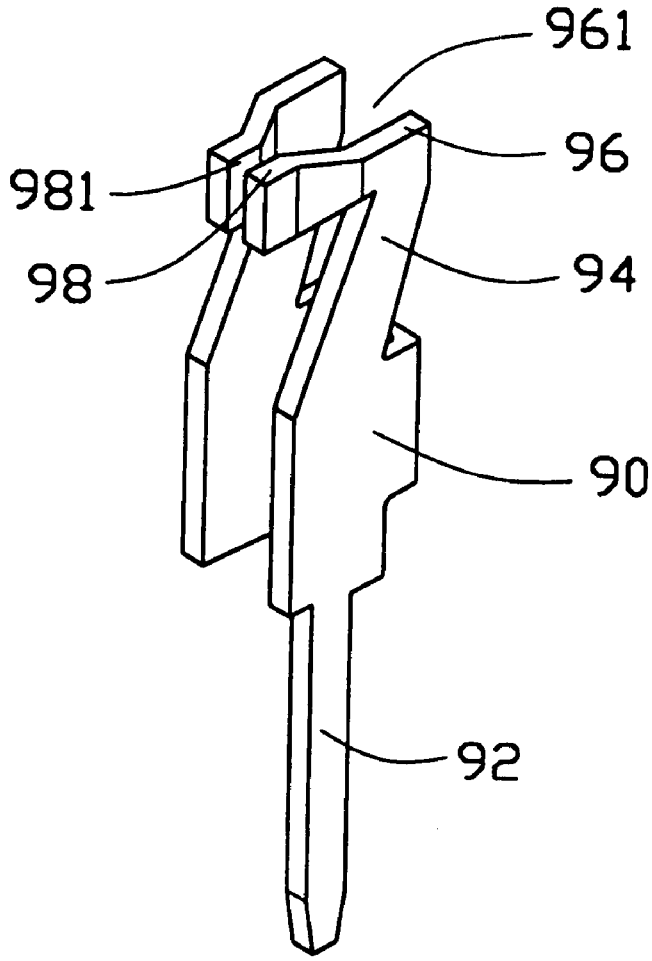
FIG. 4 (RELATED ART)
FIG. 4 is a perspective view of a conventional contact for a socket connector.

Referring to FIG. 3, a contact 1' for a CPU socket connector in accordance with a second embodiment of the present invention is essentially similar to the contact 1 of the first embodiment. The contact 1' includes a base 10', a pair of arm sections 20', and a soldering section 14'. The base 10' forms a body section 12', but without any head section such as that found in the contact 1. This design eliminates any possibility of the pin 5 interfering with a head section of the contact 1' while the pin 5 is being inserted into the contact 1'. The arm sections 20' respectively have a pair of upper arms 21' extending perpendicularly from opposite lateral edges of the body section 12', and a pair of forearms 25' respectively extending upwardly from free ends of the upper arms 21' and beyond an upper limit of the body section 12'. A length of the forearms 25' can be varied, to provide for mating with pins (not labeled) of varying lengths.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact for a socket connector comprising:

a base having a body section adapted for being secured in the socket connector; and a pair of arm sections extending from opposite lateral sides of the body section in a first horizontal direction, each arm section having a forearm, a substantially planar clamp extending from an upper end of the forearm for clamping a mating pin, and a palm extending obliquely from an end of the clamp toward the body section of the base in a second horizontal direction opposite to said first horizontal direction, wherein a length of one clamp along a direction perpendicular to the base is greater than a length of the other clamp along the said direction perpendicular to the base.

2. The contact as claimed in claim 1, wherein each arm section has an upper arm connecting the forearm to the body section of the base.

3. The contact as claimed in claim 1, wherein the arm sections extend to a height substantially the same as a height of the base.

4. The contact as claimed in claim 1, wherein the arm sections extend upwardly beyond an upper limit of the body section.

5. The contact as claimed in claim 1, wherein the base forms at least one projection on each of the opposite lateral sides thereof, each projection being adjacent the body section.

6. The contact as claimed in claim 5, wherein the projections are formed above and below the body section respectively.

7. The contact as claimed in claim 5, wherein the projections are formed above the body section respectively.

8. The contact as claimed in claim 5, wherein the projections are formed below the body section respectively.

9. A contact for a socket connector comprising:

a base having a body section adapted to be secured within the socket connector;

a pair of arm sections extending from opposite sides of the body section in a first horizontal direction, and including a pair of forearms respectively extending upwardly and toward each other with a pair of clamps at upper ends thereof for clamping a mating pin, respectively, a pair of palms obliquely extending horizontally from the corresponding clamps in a second horizontal direction opposite to said first horizontal direction, respectively, away from each other; wherein said pair of palms are offset from each other along said horizontal directions.

10. A contact pair comprising:

a pin contact; and a socket contact including:

a base having a body section;

a pair of arm sections extending from opposite sides of the body section in a first horizontal direction, and including a pair of forearms respectively extending upwardly and toward each other with a pair of clamps at upper ends thereof, respectively, a pair of palms obliquely extending in a second horizontal direction from the corresponding clamps, respectively, away from each other; wherein said pin is arranged to be freely inserted downwardly into the socket contact in an initial position, and sequentially move in said first horizontal direction opposite to said second horizontal direction under a condition of first contacting only one of said pair of palms and successively also contacting the other one until reaching a final position where said pin is sandwiched by both said pair of clamps.

* * * * *